US005649594A

United States Patent [19]

Flak et al.

[11] Patent Number: 5,649,594

[45] Date of Patent: Jul. 22, 1997

[54] METHOD AND APPARATUS FOR SERVICING A WELLHEAD ASSEMBLY

[75] Inventors: Larry H. Flak; James A. Tuppen, both of Houston, Tex.

[73] Assignee: Boots & Coots, L.P., Houston, Tex.

[21] Appl. No.: 570,291

[22] Filed: Dec. 11, 1995

[51] Int. Cl.[6] ..... E21B 23/00

[52] U.S. Cl. ..... 166/277; 166/57; 166/85.1; 166/90.1; 166/302

[58] Field of Search ..... 166/277, 302, 166/377, 379, 57, 90.1, 85.1, 85.3; 137/13, 334

[56] References Cited

U.S. PATENT DOCUMENTS

| | | | |
|---|---|---|---|
| 2,000,381 | 5/1935 | Duffy | 166/90.1 |
| 2,552,901 | 5/1951 | Miller | 166/302 |
| 3,277,964 | 10/1966 | Houpeurt et al. | 166/90.1 |
| 3,738,424 | 6/1973 | Osmun et al. | 166/298 |
| 3,885,629 | 5/1975 | Erb | 166/302 |
| 4,203,472 | 5/1980 | Dulaney | 137/828 |
| 4,372,378 | 2/1983 | Powers, Jr. | 166/57 |
| 4,396,031 | 8/1983 | Peterson et al. | 137/13 |
| 4,875,523 | 10/1989 | Thornburrow | 166/277 X |
| 5,040,600 | 8/1991 | Bailey et al. | 166/277 |
| 5,125,427 | 6/1992 | Cantu et al. | 137/13 |
| 5,146,987 | 9/1992 | Krieg | 166/302 |

*Primary Examiner*—Hoang C. Dang

[57] ABSTRACT

A method and apparatus for servicing a Christmas tree on a completed well as set forth. It incorporates a tub or bucket which fits around the casing below the Christmas tree. With the use of chilled liquid in the tub, a cold temperature region is created. A chilled water supply is connected through a flexible injection line, injection orifice, and is sprayed into the Christmas tree to flow downwardly through the chilled region. And ice plug is formed on the interior of the pipes defining the casing and production tubing strings. Ice is formed from the exterior to the interior, thereby plugging the well and enabling servicing.

20 Claims, 1 Drawing Sheet

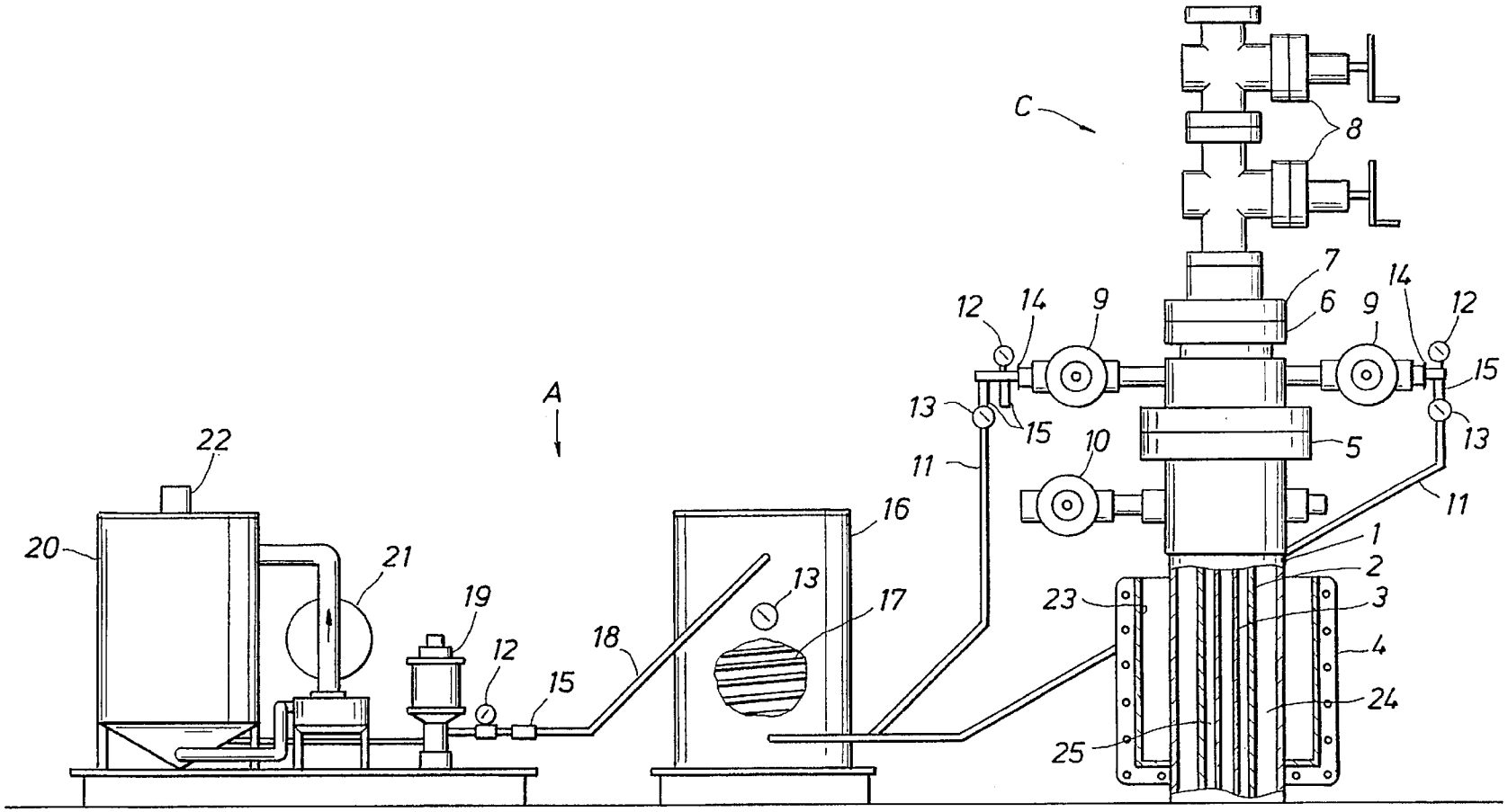
1
2
3
4
5
6
7
8
9
10
11
12
13
14
15
16
17
18
19
20
21
22
23
24
25
A
C

METHOD AND APPARATUS FOR SERVICING A WELLHEAD ASSEMBLY

BACKGROUND OF THE INVENTION

This disclosure is directed to a method and apparatus for servicing a wellhead assembly. A wellhead assembly is sometimes known as a Christmas tree and is the equipment which is attached at the top of a well, normally standing above the ground and looks like a Christmas tree. The Christmas tree construction typically involves an upstanding set of control valves, flanges and other couplings which enable connection of the well to any number of flow lines. For instance, the equipment typically joins to a gathering line. There is also a connection to the casing so that the Christmas tree is raised.

A well is first drilled with no assurance that the well will be a producing well. Typically, the well is drilled to a specified depth, and perforations are placed into the side of the partly completed well into formations to obtain production. If the production is adequate, the well is cased and cemented. At that stage of proceedings, if the production flow rate is adequate, then the well will be completed. A completed well normally includes a production tubing string which extends from the producing formation up to the surface. The production tubing string is located on the interior of the casing. The casing extends to the surface around the production tubing string. The combination of the casing and the external cement layer prevents leakage of artesian water along the well borehole on the exterior. If the casing were not cemented in place, it might readily permit salt water to migrate upward or downwardly into formations where salt water is not desirable. The casing is longer than the tubing string because the tubing string may not extend to the bottom or total depth of the well that is actually cased. The production tubing string is located on the interior of a production casing string. Both are several thousand feet in length. In addition, there typically is a surface casing which provides some isolation at the immediate area of the wellhead so that an annular space extends downwardly on the inside of the surface casing perhaps only 200 feet to as much as 2,000 feet in depth.

The several pipes defined above are the production tubing, the producing casing, and the surface casing all support the Christmas tree or wellhead assembly. The Christmas tree is affixed at the exposed upper end of the concentrically arranged pipes just mentioned. The Christmas tree normally includes a wellhead assembly which supports multiple laterally extending valves which are installed with suitable mounting flanges. The Christmas tree can have a variety of valves and fittings attached to it depending on the particular requirements. In the present disclosure, a relatively simple and common producing well is described i.e. a well having one production tubing concentric within the casing. The wellhead attached to the casing extends typically between 5 and 15 feet in height. In some instances, it can even be taller depending on the requirements on the particular wellhead assembly.

There are any number of valves including production casing valves and production tubing valves attached to the wellhead assembly. These valves are periodically opened and closed. Over time, wear in the use of these valves accumulates, and leakage will occur. This requires service including the occasion of removing one or more of the valves, changing out the valve seats, replacing the valve seals, dressing the valve elements and other of steps. All of these steps require that the well be interrupted so that flow is no longer permitted. After a well has been in service for a number of years, the formation drive pressure maybe reduced. If the well is shut-in by the wrong technique, it can kill the well temporarily, perhaps damage the formation, and thereby prevent production flow from the well when the wellhead has been serviced. It is highly undesirable to stop the flow using certain approaches. One technique which is highly detrimental is filling the production tubing string full of a weighted fluid such as drilling mud. If the pressure balance becomes reversed, the production fluid can be forced into the producing formation, thereby filling the formation in an annular region near the well, plugging the perforations and preventing subsequent flow.

There are other techniques for killing a well which are less detrimental. The present disclosure sets forth one such approach. Competing approaches are set forth in the referenced patents which describe the status of the prior art.

U.S. Pat. No. 2,552,901 of Miller sets forth a refrigeration system utilizing the container 19 filled with ice water or dry ice at 18. The freezing procedure extends to the interior so that water will form a static ice plug on the interior. This freezes on the interior of the casing 7. It is located below the Christmas tree.

U.S. Pat. No. 3,738,424 describes a production procedure, especially for a producing well, to get control during a blow out, and features the long central tubing string shown in the drawings which is supported with a number of radial disk 30 attached to the tubing 31. In FIG. 3, a flow path is shown from the bottom valve, into the well, through the disk, and back out through the outlet to the duplicate upper valve. At column 4, it describes the flowing liquid nitrogen introduced through the tubing 60. That provides the freezing. Freezing is imparted to water flowing the tubing string T.

U.S. Pat. No. 4,203,472 of Delaney shows a jet mechanism in the nozzles 28 shown in FIG. 2 of the drawings which are directed radially inwardly to form a frozen plug. Freezing occurs on the exterior of the pipe 26.

U.S. Pat. No. 4,372,378 of Powers sets forth a special joint to the installed during drilling to prevent a blow out. According to this disclosure, the special joint or session is installed so that nothing is done during regular drilling. When there is a blow out, a refrigerated fluid is delivered to flow in corporation with a set of flow deflectors which become active during the blow out. This enables freezing during reverse flow typified by a blow out.

U.S. Pat. No. 4,396,031 of Peterson is a simple two pipe enabling water to be added. With subsequent cooling in the flow, freezing can be accomplished. Presumably, it is intended to be used to control a blow out, see column 1.

U.S. Pat. No. 5,125,427 of Cantu sets forth a specific additive. The organic material includes identified alcohols or paraffins. This is used as an injectant. The specific location of the injectant is not shown in the drawings (there are none) and it apparently involves use at any location.

The present disclosure sets forth both a method and apparatus for servicing a Christmas tree or wellhead assembly in a fashion which does not harm the well. More importantly, it is a procedure which can be carried out with great safety. When removing parts of the Christmas tree, there is the risk of escape to atmosphere of oil, gas, water or any mix thereof. The present disclosure plugs the well in a fashion which enables service personnel to carry out any necessary servicing step at the wellhead. Indeed, servicing can include removal of portions of the Christmas tree. This process particularly enables portions to be removed and replaced.

Briefly summarizing, the present disclosure sets out a method and apparatus for servicing. The servicing approach utilizes a tub or bucket which is assembled around the outermost surface casing and which is filled with a cold liquid inside of a liner seal. The liners serves as a seal in the bucket. Moreover, liquid is added which preferably cools to a very cold temperature, and pieces of dry ice are dropped into the liquid.

In addition to that, access is gained to the one or more annular spaces on the interior of the bucket. In that region, a small trickle or spray of water or a gel fluid subject to freezing is introduced. The water is frozen, thereby plugging the annular space with an ice plug. The ice plug is built from the exterior inwardly. The ice plug completely blocks fluid flow in the annular space. This is done for every annular space, finally positioning a surrounding ice plug about the production tubing string. At that point in time, the Christmas tree can be opened, disassembled, and servicing can then be carried out. Examples will be given.

BRIEF DESCRIPTION OF THE DRAWINGS

So that the manner in which the above recited features, advantages and objects of the present invention are attained and an be understood in detail, more particular description of the invention, briefly summarized above, may be had by reference to the embodiments thereof which are illustrated in the appended drawings.

It is to be noted, however, that the appended drawing illustrate only typical embodiments of this invention and are therefore not to be considered limiting of its scope, for the invention may admit to the equally effective embodiments.

The single view shows a Christmas tree undergoing service through the use of the apparatus of the present disclosure wherein the service procedure isolates the producing well with an ice plug.

DETAILED DESCRIPTION OF THE PREFERRED EMBODIMENT

Going to the single drawing, the Christmas tree is indicated by the letter C and is affixed at the well and extends above the surface of the earth. That is the equipment which is subjected to wear and tear during use and for which repair services are required. The repair services are carried out with the portable apparatus generally indicated by the symbol A. The portable apparatus is installed and connected at a fashion which will be given. This enables the Christmas tree to be serviced after the well is frozen.

Going specifically now to the equipment shown in the single drawing, the surface casing pipe 1 is typically installed at the time that a well is spudded thereby providing a conduit through which subsequent drilling procedures are conducted. This pipe is exposed at the upper end extending above the ground, and has a depth of perhaps 200 feet. The length of the surface casing is variable depending on the type of soil and other localized conditions. It can be longer or shorter. A production or intermediate casing string 2 is installed in the completed well. When cased, the casing extends from the top to the bottom and is held in place by a surrounding layer of cured cement. The cement is applied by pumping cement down through the casing and out through the bottom so that it flows back on the exterior around the casing. This prevents leakage on the exterior of the casing. This assures that produced fluids are relatively isolated. The production casing 2 is noted at the surface and is generally arranged concentric of the surface casing 1.

Assuming successful completion of a well, the production tubing 3 is then installed. Assume that a producing zone of 100 feet is located. Typically, above and below that producing zone, packers will be installed to isolate that particular zone. The production tubing string extends to that zone and passes through the top packer to produce that zone. Production from that zone is then directed upwardly through the production tubing 3. It is not uncommon for the production to be a mixed phase flow including gas, oil, water, and perhaps even particles of sand or other debris. This mixed phase flow is delivered to the surface through the production tubing. Annular dual completion strings work in the same fashion.

At the surface, a wellhead assembly 5 is attached to the three concentric pipes described. It includes a connection so that the pipes are also supported, held in alignment, sealed from one another, and terminate at the requisite locations. The several concentric pipes are beneath the wellhead assembly 5. Above that, there is a casing head 6 and it connects with a tubing bonnet 7. These are joined together with a number of nuts and bolts which fasten industry standard flanges together. The tubing bonnet 7 is concentric with the assembly so that it can connect with the production tubing string 3. There are one or more serially connected Christmas tree valves 8 which are aligned to deliver flow from the production tubing string 3. This concentric connection directs flow out through the valves 8 and then to a gathering line. Typically, two valves are used to have a backup system. This also enables connection with a lubricator should it be necessary to force service equipment through the valves 8.

The Christmas tree includes a set of production casing valves 9. They connect with an annular space which will be defined. In addition, there are surface casing valves 10 which connects with a second annular space to be described.

While the foregoing sets forth certain aspects of the Christmas tree C, the portable apparatus A is brought to this area and is installed at the wellhead assembly C. This field service is carried out at the location of the wellhead assembly. It is done typically by service personnel traveling to the location. The portable apparatus A is carried on the truck and is located in the field for servicing. The first step is to install a two part bucket 4 around the surface casing 1 as shown in the drawing. The bucket is divided in half. It is assembled so that, when complete, it has the form of a donut. This defines a circular trough or container that fully encircles the surface casing pipe 1. So that no leakage occurs, a donut shaped seal or liner typically formed of rubber or the like is placed in the bucket 4. The liner is a flexible leak proof member. The liner can be one or two piece construction. It need not be thick so that heat transfers readily through the surface casing pipe 1. The present apparatus is connected to the Christmas tree C through one or more insulated injection lines 11 shown in the single drawing. They deliver chilled water for purposes to be described. The insulated injection lines 11, there being at least one in the preferred embodiment, each connect with a pressure gage 12, a temperature gage 13 and direct flow through a metering valve 15 and deliver flow through an injection orifice 14. More specifically, the production casing valves 9 are unthreaded (commonly, they attach with industry standard bolts in a standard size flange) to the extent that access is obtained to them. If need be, the parts in such valves can be removed in a fashion believed to be well known in the industry, and the injection orifice assembly 14 is then threaded into the valves. By making the appropriate connections as illustrated in the drawing, chilled water as will be described is delivered through the production casing valves 9 and flows downwardly into an annular region for chilling. This will be given in specific details hereinafter.

The injections lines are thus provided with chilled water. They originate with a cooler assembly 16. The cooler assembly 16 supports a set of chilling coils 17 which are arranged on the interior and which are submerged in liquid. This drops the temperature of water in the coils 17. The coils 17 are serially connected with the injection lines 11. This enables fluid flow to be delivered for injection into the wellhead and/or Christmas tree C. The insulated injection line 11 is serially connected with the chiller coil 17 and that in turn is connected to receive water under pressure from a pump line 18. The pump line 18 originates with a pump 19 which is an injection pump. The pump 19 delivers water at a controlled pressure. Obviously, the water flows through a needle valve assembly connected downstream from the pump 19, and the pressure in this line is indicated by a suitable pressure gage.

The numeral 20 identifies a slurry tank. The slurry tank is provided with a slurry tank pump 21. It is connected with an intake from the bottom of the slurry tank so that sediment in the bottom of the tank is recycled through the pump 21 and flows back to the top. This recirculation cycle in the slurry tank helps keep solid particles in circulation. This helps provide a consistent weight of pumped slurry. The numeral 22 identifies a motor for a slurry blender which drives a set of paddles or churning device located in the tank. This stirs during pumping so that the slurry in the tank is adequately stirred and mixed.

Consider the sequence of operations which are recommended in the use of the present invention. The equipment is constructed for field use. Field connections are made to the Christmas tree C. The field connections enable the equipment to operate in a fashion to be described. The first step is to fill the tank 20 with water and other additives. The additives typically include drilling fluid additives to the control the weight of the water. In addition, other additives can be mixed with the water which control frothing. One important additive is an additive which controls the freezing temperature. For purposes of description, assume that the slurry in the tank 20 freezes at about 25° F. It is stirred continuously. This is accomplished through the continued recycling of the water through the pump 21 and operation of the blender motor 22. The pump 19 is started at the desired moment. The valve in the line 18 is adjusted and the pumped water is then delivered into the chiller tank 16. Residence time is controllable by the number of coils 17 in the tank. It is also controlled by the flow rate of the pump 19 and this is subject to adjustment by changing the flow control valve which is connected between the pump 19 and the chiller tank 16. Chilled water is ultimately delivered through the insulated injection lines 11. They are connected so that they have an output to the Christmas tree. They deliver water which is input to an annular space. This water is sprayed through an orifice to form a mist. Droplets accumulate on the interior of the various concentric metal members including the concentric pipes. The water flows downwardly passed the chilled tub or bucket.

There is a first annular space identified by the numeral 24. This annular space is plugged by freezing of a mist into the annular space 24. The annular space depth is variable dependent on the well, and it is usually cemented. It can plugged by forming ice with mist delivered in contact with the casing 1. Ice is formed from the outside to the inside of the annular space 24. Complete plugging is accomplished. In an alternate approach, this annular space can simply be filled with water. Ordinarily, there is no ambient back pressure in the annular space 24. It can be filled from the bottom to the top in just a moment or two assuming that the annular space 24 is relatively shallow. An ice plug is formed which has a length at least equal to tub 4. It is frozen solid to provide better heat transfer through the ice. Once that ice plug is formed in the annular space 24, the next step in the procedure involves introduction of water in the form of mist into the annular space 25. This annular space is several thousand feet deep, indeed, if it were filled it might cause damage to the well. Therefore in this region, a mist or spray is introduced. Typically, droplets of water run down the production casing 2, and they freeze when they arrive at the chilled region. A plug of ice is built in the annular space 25 which extends from the exterior to the interior until this annular space is completely plugged. In that region, plugging is accomplished so that the annular space 25 is no longer able to provide a fluid flow pathway to the surface.

It is possible to form an ice plug inside the production tubing 3. This is done by disconnection of the orifice 14 from the valve 9 and reconnection to the valve 8 at the top of the Christmas tree C. Again, this is plugged after the ice plug is formed in the annular space 24 and the annular space 25. When that is done, the entire well is plugged and there is no pathway or flow through the concentric pipes 1, 2 and 3. Whatever the circumstances, an accumulated ice plug is formed concentrically from the exterior to the interior and all of the annular spaces are plugged. During this ice plug forming process, care is taken through constant monitoring to assure that a liquid slurry in the tub 4 is maintained at the proper temperature. One suitable approach is to put dry ice into the tub 4, mix it with any suitable antifreeze liquid such as ethylene glycol or the like. Pieces of dry ice are dropped into the antifreeze mixture. Chilling to the desired cold temperature is then accomplished. This enables formation of the ice plugs on the interior of the tub 4. When that has been accomplished, personnel at the surface will note the formation of the ice plug. Assume that the injection line is delivering water above the completed ice plug. There will be an increase in pressure. The increase in pressure will be noted because there is an isolated area above the ice plug.

By then turning off the pump 19, wellhead pressures can be tested to see that the wellhead C has been isolated from formation pressures by the formation of the ice plug. This enables servicing of the Christmas tree assembly C. An exemplary service protocol involves the replacement of the valves 8, 9 and 10. Alternately, they may be serviced in place. This can readily involve the removal of the valve element or valve seats. Packing can be renewed around the stems of the various valves. If the seat has been cut by the production of sand in the production fluids, the seats can be serviced or replaced. This procedure is carried out securely and safely isolated from high pressure formation fluid. The frozen plugs in the annular spaces 24 and 25 are captured so they cannot escape, and they are also maintained continuously at the cold temperature necessary to initiate the process. In the example given earlier, the injected water was described as freezing at 32° F. To assure that this is continued, the liquid in the tub 4 typically is maintained at a colder temperature, such as −110° F. for dry ice in methanol.

The valves 8, 9 and 10 are serviced to a new condition. Then, thawing is initiated. The tub 4 is simply drained and removed. The equipment A is removed from the area. The ice plugs in the various annular spaces on the interior are then permitted to thaw. As they thaw, the annular spaces are cleared of ice. The surface connected pipes 1, 2 and 3 are restored to the original condition. This then completes the service routine. Moreover, this enables the crew to move to another wellhead for servicing. This can be done repetitively for any number of Christmas trees C. Indeed, a single crew can carry two or three sets of the equipment A shown in the single drawing which are at different stages of installation, services and disassembly. It is not uncommon to require perhaps three or four hours initially form the ice plugs which are necessary for servicing. The time required for thawing is less significant because the crew operating the equipment A need not watch the wellhead operation while thawing occurs on the interior of the pipes 1, 2 and 3. At that juncture, thawing is simply assumed to occur, and the crew can check after the equipment has been removed and thawing initiated to see that production is flowing through the Christmas tree C. While the foregoing is directed to the preferred embodiment, the scope is determined by the claims which follow.

We claim:

1. A method of servicing a producing well wherein the producing well includes a surface located Christmas tree and the Christmas tree is connected at least to a well casing and a well production tubing within the casing and the method comprises the steps of:

(a) forming a chilled liquid in a container which liquid is in contact with the casing below the Christmas tree on the well;

(b) mixing water with additives, then chilling the mixed water and delivering the chilled water through a connective line wherein the water is sprayed into the Christmas tree for forming a downward flow through the Christmas tree;

(c) freezing the water flow until an annular plug is formed extending radially inwardly from the casing so that an annular flow area within the casing is plugged by ice;

(d) servicing the Christmas tree assembly; and (e) after servicing, restoring the Christmas tree to operation and thereafter thawing the ice formed below the Christmas tree.

2. The method of claim 1 wherein the water for freezing is introduced through the Christmas tree by spraying over time the water in the Christmas tree to flow downwardly wherein the water is then subjected to freezing temperatures.

3. The method of claim 1 wherein a first ice plug is formed in a larger annular region and then a second ice plug is formed on the interior of the first ice plug.

4. The method of claim 1 including the step of removing sufficient components from Christmas tree valves so that an injection orifice can be placed therein, and then delivering a flow of injected chilled water through the Christmas tree to form a spray.

5. The method of claim 4 including the preliminary step of chilling water to a reduced temperature at which the water is still liquid, and then injecting the water at a raised pressure through the Christmas tree.

6. The method of claim 5 including the step of dropping the freezing temperature of the water to a specified reduced temperature by additives in the water.

7. The method of claim 5 including the step of raising the freezing temperature of the water by additives in the water.

8. The method of claim 1 including the preliminary step of assembling a liquid holding bucket around the casing below the Christmas tree and then filling the bucket with chilled liquid.

9. The method of claim 1 including the step of monitoring the pressure of water introduced through the Christmas tree wherein a change in pressure indicates that a complete ice plug has been formed below the Christmas tree thereby preventing flow through the ice plug.

10. The method of claim 1 wherein the ice plug is thawed to restore the well to production.

11. The method of claim 1 including the step of forming the ice plug from the exterior of the Christmas tree to the interior of the Christmas tree.

12. The method of claim 11 including the step of forming the ice plug from the exterior through an external concentric pipe to an internal concentric pipe comprising said Christmas tree.

13. The method of claim 1 including the step of freezing the water with a surrounding liquid container having an antifreeze liquid therein cooled with dry ice.

14. A method of servicing a producing well wherein the producing well includes a surface located Christmas tree and the Christmas tree is connected at least to a well casing and a well production tubing within the casing and the method comprises the steps of:

(a) chilling liquid in a container against the casing at the wellhead of the well;

(b) mixing water with additives, then chilling the mixed water and delivering the chilled water through a connective line wherein the water is sprayed into a Christmas tree for forming a downward flow through the Christmas tree;

(c) freezing the water to form an annular plug extending radially inwardly from the casing so that flow within the casing is plugged by ice;

(d) servicing the well above the annular plug; and (e) after servicing, restoring the well to operation by thawing the ice plug.

15. The method of claim 14 wherein the water for freezing is introduced through the Christmas tree by spraying over time the water in a Christmas tree to flow downwardly wherein the water is then subjected to freezing temperatures.

16. The method of claim 14 wherein a first ice plug is formed in a larger annular region and then a second ice plug is formed on the interior of the first ice plug.

17. The method of claim 14 including the step of removing sufficient components from Christmas tree valves so that an injection orifice can be placed therein, and then delivering a flow of injected chilled water through a Christmas tree to form a spray.

18. A method of servicing a producing well wherein the producing well includes a surface located Christmas tree and the Christmas tree is connected at least to a well casing and a well production tubing within the casing and the method comprises the steps of:

(a) forming a chilled liquid in a container which liquid is in contact with the casing below the Christmas tree on the well;

(b) removing sufficient components from Christmas tree valves so that an injection orifice can be placed therein;

(c) delivering a flow of injected chilled water through a Christmas tree to form a spray;

(d) freezing the water flow until an annular plug is formed extending radially inwardly from the casing so that an annular flow area within the casing is plugged by ice;

(e) servicing the Christmas tree assembly and (f) after servicing, restoring the Christmas tree to operation and thereafter thawing the ice formed below the Christmas tree.

19. The method of claim 18 wherein the water for freezing is introduced through the Christmas tree by spraying over time the water in the Christmas tree to flow downwardly wherein the water is then subjected to freezing temperatures.

20. The method of claim 19 wherein a first ice plug is formed in a larger annular region and then a second ice plug is formed on the interior of the first ice plug.

* * * * *